US007014974B1

(12) United States Patent
Almog et al.

(10) Patent No.: US 7,014,974 B1
(45) Date of Patent: Mar. 21, 2006

(54) SUBSTRATE COATING FOR IMPROVED TONER TRANSFER AND ADHESION

(75) Inventors: Yaacov Almog, Nes-Ziona (IL); Sergio Brandriss, Rehovot (IL)

(73) Assignee: Hewlett-Packard Co., Fort Collins, CO (US)

( * ) Notice: Subject to any disclaimer, the term of this patent is extended or adjusted under 35 U.S.C. 154(b) by 0 days.

(21) Appl. No.: 10/088,655

(22) PCT Filed: Sep. 22, 1999

(86) PCT No.: PCT/IL99/00510

§ 371 (c)(1),
(2), (4) Date: Mar. 14, 2002

(87) PCT Pub. No.: WO01/22172

PCT Pub. Date: Mar. 29, 2001

(51) Int. Cl.
*G03G 9/08* (2006.01)

(52) U.S. Cl. ..... 430/117; 428/195.1; 428/331

(58) Field of Classification Search ..... 428/32, 428/34, 195.1, 331; 430/117
See application file for complete search history.

(56) References Cited

U.S. PATENT DOCUMENTS

| | | | | |
|---|---|---|---|---|
| 4,959,661 A | | 9/1990 | Buxton et al. | |
| 5,073,448 A | | 12/1991 | Vieira et al. | |
| 5,308,680 A | * | 5/1994 | Desjarlais et al. | 428/32.5 |
| 5,411,787 A | * | 5/1995 | Kulkarni et al. | 428/32.11 |
| 5,518,809 A | * | 5/1996 | Henry et al. | 428/32.14 |
| 5,612,281 A | | 3/1997 | Kobayashi et al. | |
| 5,656,378 A | | 8/1997 | Lambert | |
| 5,827,627 A | * | 10/1998 | Cleckner et al. | 430/18 |
| 5,972,457 A | | 10/1999 | Matsuishi et al. | |
| 6,319,591 B1 | | 11/2001 | Malhotra | |

FOREIGN PATENT DOCUMENTS

| | | | |
|---|---|---|---|
| EP | 0 507 998 | | 10/1992 |
| EP | 0 789 281 | | 8/1997 |
| EP | 0 892 008 | | 1/1999 |
| JP | 09-114122 | * | 5/1997 |

OTHER PUBLICATIONS

Grant & Hackh's Chemical Dictionary (5th ed.), McGraw-Hill Book Co (R. Grant and C. Grant, eds)(1987) (p 145).*
Haneda, A.; JP 63-033749; Feb. 13, 1998 & Patent Abstracts of Japan; Jul. 9, 1988; vol. 012; No. 243 (P-728).
Dynic Corp.; JP 09-114122; May 2, 1997 & DATABASE WPI; Section Ch, Week 199728; Derwent PublicationsLtd.; London; GB; Class A89; AN 1997-302654;XP002137702.
DAICEL-UCBKK; JP 09-157315; Jun. 17, 1997 & DATABASE WPI; Section Ch, Week 199734; Derwent Publications Ltd.; London; GB; Class A14; AN 1997-369487;XP002137736.
Translation of DAICEL-UCB KK; JP 09-157315; Jun. 17, 1997 & DATABASE WPI; Section Ch, Week 199734; Derwent Publications Ltd.; London; GB; Class A14; AN 1997-369487; XP002137736.

* cited by examiner

*Primary Examiner*—B. Hamilton Hess

(57) ABSTRACT

A printing method comprising: providing a substrate having a surface coated wiht a coating comprising at least 25% silica; and printing on the coated surface with an ink comprising pigmented polymer particles and a carrier liquid.

70 Claims, No Drawings

SUBSTRATE COATING FOR IMPROVED TONER TRANSFER AND ADHESION

RELATED APPLICATIONS

The present application is a US national application of PCT Application No. PCT/IL99/00510, filed on Sep. 22, 1999.

FIELD OF THE INVENTION

This invention is concerned with primers used for printing and more particularly with primers that have high affinity for both the ink and plastic such as used in substrates and compact disks (CD's).

BACKGROUND OF THE INVENTION

Primers or binders are generally necessary when printing with liquid toners on some plastic materials, such as PET, polycarbonate or other substrates. Without binders, such toners do not adhere well to the surface to be printed upon. Thus, a binder material is needed that has a high affinity for both the toner and the plastic. In the past, solvent based primers were used. However, the solvents in use are not environmentally friendly and are therefore commercially problematic.

However, it is difficult to provide a primer that is environmentally friendly and nonetheless has a high affinity for both the toner and the plastic. In general, it has been found that binders which are applied dissolved in solvents, which evaporate and leave a cured binder work best for this task. Such binders are generally acrylates. However, such primer systems do cause air pollution when the solvents evaporate.

Primers which are UV cured and/or applied in an aqueous solution are advantageous since they are non-polluting. Acrylic based monomers are known for use as UV cured binders. It is known to use hyrolized PVA (applied as a aqueous solution) for a binder. However, such binders, while they adhere well to plastic substrates, do not adhere well to toners such as those based on Nucrel (coplymers of ethylene and an alpha, beta ethelenically susaturated acid of either acrylic or metacrylic acid by E. I. du Pont) and Surlyn (ionomer resins by E. I. du Pont) polymers. Such polymer based toners are sold, for example, by Indigo, N.V. of the Netherlands under the trade name ElectroInk. The ElectroInk brand toners comprise pigmented polymer particles, a carrier liquid such as a Isopar (solvent of branched-chain aliphatic hydrocarbons and mixtures thereof, e.g., isoparapffinic hydrocarbon fractions by EXXON) or Marcol (highly refined petroleum oils by EXXON).

SUMMARY OF THE INVENTION

An aspect of the invention is concerned with the modification of presently available binders which are not solvent based to improve the adhesion of toner materials to them.

In some preferred embodiments of the invention, these available binders are acrylic based monomers. In some preferred embodiments of the invention, the available binders are UV cured. In some preferred embodiments of the invention, the binders are not dissolved in organic solvents when they are applied. In some preferred embodiments of the invention, the binders have more than one of these characteristics.

An aspect of some preferred embodiments of the invention is concerned with the provision of a UV cured binder which has high adhesion to plastic substrates and also to toner materials, such as the aforementioned ElectroInk brand materials.

In a preferred embodiment of the invention, the binder comprises a high concentration of a material which absorbs the carrier liquid. In preferred embodiments of the invention, nano-silica (5–50 nanometers) is used as the absorber. Such particles should is preferably present in a concentration of at least 25 percent, more preferably between 30 and 50 percent and most preferably 35 and 45 percent. These percentages are by weight of total solids after curing.

While the exact operation of this absorber material is not known, it is believed that the addition of this material to the binder and the subsequent drawing of the toner to the binder by the material enables close approach of the toner polymer to the binder, such that strong, but very short range, Van der Waals forces take effect. Such forces strongly bind the toner polymer to the binder. Without the addition of the material, repulsion caused by the acid nature of both toner particles and binder is believed to mitigate the effect of such forces. However, the exact nature of the mechanism that obviates the use of said binders in the prior art is not yet established.

In a preferred embodiment of the invention, anchorage agents such as an amine material, especially diamine terminated polyoxyethelene, diamene, triamine or monoamine terminated Polypropylene oxide, are added to the binder coatings to increase their adhesion to the toner materials. Other anchorage agents can also be used, especially those with an amino terminated polymer backbone.

In a preferred embodiment of the invention, the binders comprise acrylic based UV curable monomers with mono, di and tri functionality. As indicated above, such binders, by themselves, are generally ineffective for use with negatively charged toners.

An aspect of some preferred embodiment of the invention is concerned with the addition of carrier liquid absorbing materials such as nano-silica, to other, non-UV cured binder materials such as, for example, water soluble hydrolized PVA. It was found that at high proportions of nano-silica, such as for example 25 percent or more by weight of total solids, the coating started to become "tonerphilic", in terms of transfer and adhesion to the binder.

There is thus provided, in accordance with a preferred embodiment of the invention, a printing method comprising:

- providing a substrate having a surface coated with a coating comprising at least 25% silica; and
- printing on the coated surface with an ink comprising pigmented polymer particles and a carrier liquid.

Preferably the coating comprises an acrylic material, for example a cross-linked polyacrylic ester.

Preferably, the coating is UV cured.

In various preferred embodiments of the invention the silica content of the coating comprises at least 30% silica, at least 35% silica, at least 40% silica, at least 45% silica and at least 50% silica.

In various preferred embodiments of the invention the silica has a size of between 5 and 50 nanometers, between 10 and 40 nanometers, between 10 and 20 nanometers or about 16 nanometers.

In a preferred embodiment of the invention, the silica is not chemically bonded to the rest of the coating. Alternatively, the silica is chemically bonded to the rest of the coating.

Preferably the coating further comprises an anchorage agent. Preferably, the anchorage agent comprises an amine material. Preferred amine materials include diamine, monoamine and triamine terminated substances. Preferably the substance is Poly(propylene oxide) or Poly-oxyelthelene.

In a preferred embodiment of the invention, the substrate and the pigmented particles are both acidic.

In a preferred embodiment of the invention the substrate is coated with a polyamide coating between the coating containing silica and the substrate.

In various preferred embodiments of the invention, the substrate is PVC, PET or Polycarbonate.

Preferably, the coating forms a substantially smooth surface.

In a preferred embodiment of the invention, the substrate is a sheet of material. In an alternative preferred embodiment it is a disk, such as a CD disk.

There is further provided a substrate comprising:

a sheet of polymer; and a substantially smooth printable coating on the polymer sheet comprising at least 25% silica.

Preferably the coating comprises an acrylic material, for example a cross-linked polyacrylic ester.

Preferably, the coating is UV cured.

In various preferred embodiments of the invention the silica content of the coating comprises at least 30% silica, at least 35% silica, at least 40% silica, at least 45% silica and at least 50% silica.

In various preferred embodiments of the invention the silica has a size of between 5 and 50 nanometers, between 10 and 40 nanometers, between 10 and 20 nanometers or about 16 nanometers.

In a preferred embodiment of the invention, the silica is not chemically bonded to the rest of the coating. Alternatively, the silica is chemically bonded to the rest of the coating.

Preferably the coating further comprises an anchorage agent. Preferably, the anchorage agent comprises an amine material. Preferred amine materials include diamine, monoamine and triamine terminated substances. Preferably the substance is Poly(propylene oxide) or Poly-oxyelthelene.

In a preferred embodiment of the invention, the substrate is acidic.

In a preferred embodiment of the invention the substrate is coated with a polyamide coating between the coating containing silica and the substrate.

In various preferred embodiments of the invention, the substrate is PVC, PET or Polycarbonate.

Preferably, the coating forms a substantially smooth surface.

There is further provided, in accordance with a preferred embodiment of the invention, a composition of matter comprising an acrylic monomer material comprising between 40% and 75% of the composition; and silica, in an amount exceeding 25% of the composition, which silica is not chemically bound to the monomer.

Preferably, the acrylic material comprises an acrylic ester.

Preferably, the monomer is UV curable.

In various preferred embodiments of the invention the silica content of the composition comprises at least 30% silica, at least 35% silica, at least 40% silica, at least 45% silica and at least 50% silica.

In various preferred embodiments of the invention the silica has a size of between 5 and 50 nanometers, between 10 and 40 nanometers, between 10 and 20 nanometers or about 16 nanometers.

In a preferred embodiment of the invention, the silica is not chemically bonded to the rest of the composition. Alternatively, the silica is chemically bonded to the rest of the composition.

Preferably the composition further comprises an anchorage agent. Preferably, the anchorage agent comprises an amine material. Preferred amine materials include diamine, monoamine and triamine terminated substances. Preferably the substance is Poly(propylene oxide) or Poly-oxyelthelene.

The invention will be more clearly understood with reference to the following non-limiting examples of preferred embodiments thereof.

DETAILED DESCRIPTION OF PREFERRED EMBODIMENTS

The present invention is believed to be applicable to a wide range of binder materials, substrates and toner materials. Some representative, non-limiting, examples of the application of the present invention follow.

EXAMPLE 1

Various amounts of nano-silica (Aerosil R972 by Degussa) was dispersed in UV curable acrylic esters (Cray Valley Pro 2698). Aerosil R972 is a nanometric hydrophobic silica material having a particle size of approximately 16 nanometers. Other sizes, such as between 5 and 50 nanometers are also believed to be useful in the practice of the invention. Since the addition of silica to the acrylic monomer increases its viscosity, isopropyl alcohol. (IPA) was added to the dispersion so that it could be coated onto a substrate. A wide range of acrylic esters are useful in the practice of the invention.

The dispersions were wire rod coated on 330 micrometer thick PVC sheets pre-coated with PA polyamide (Mazzuccelli) and exposed to light from a UV mercury lamp which provides 118 watts/cm and passes the light source at a velocity of about 8.64 cm/sec or about 13.6 joules/cm$^2$. (A lamp having a power of 300 w/inch and motion of the substrate at a rate of 17 ft/min.) The resulting coated material was used as a substrate, for ElectroInk™ type 3.1 ink (liquid toner comprising pigmented toner particles and carrier liquid) of Indigo™, N.V., on an Omnius™ CardPress™ printer of the same company. In this printer a liquid toner image is developed on a photoreceptor and transferred to an intermediate transfer member for subsequent transfer to the substrate by heat and pressure. During the second transfer process the image is also fused and fixed to the substrate.

The tested formulations (all parts are by weight) and the results are:

| | Parts Acrylic Ester | Parts Silica | Parts IPA | NVS | Results |
|---|---|---|---|---|---|
| Control 1 | 10 | 0 | 1 | 91% | No transfer to substrate |
| Control 2 | 8 | 0 | 3 | 73% | No transfer to substrate |
| A | 10.4 | 1 (9%) | 1 | 92% | No transfer to substrate |
| B | 5 | 1 (16.7%) | 1.75 | 77.5% | Traces of ink transferred |
| C | 2.5 | 1 (29%) | 2 | 64% | Good transfer and fixing |
| D | 1.5 | 1 (40%) | 1.75 | 60% | Good transfer and fixing |

In the table, NVS is the percentage of non-volatile solids in the coating mixture and the percentages under silica are percent silica of the NVS. All proportions in these and other examples are by weight. For dispersion D, the coating was somewhat uneven due to the large amount of silica in the coating. However, the transfer and fixing were good. The fixing was poor immediately after transfer but improved to good within a week after printing. From the table it appears that the coating changes from "tonerophobic" to "tonerophilic" at about 25% silica loading and that when transfer is good so is fixing.

EXAMPLE 2

Various amounts of nano-silica (Aerosil R972 by Degussa) was dispersed in an aqueous acrylic copolymer solution (Glascol LS16, Allied Colloids—about 30% NVS). Aerosil R972 is a nanometric hydrophobic silica material having a particle size of approximately 16 nanometers. Other sizes, such as between 5 and 50 nanometers are also believed to be useful in the practice of the invention. The dispersions were homogenized in a high shear mixer for 1–3 minutes. The dispersions were diluted with water for high proportions of silica, their viscosity made them difficult to homogenize.

The dispersions were wire rod coated onto PET films and dried at elevated temperature (about 60° C. to form a film. The resulting coated material was used as a substrate, for ElectroInk™ type 3.1 ink (liquid toner comprising pigmented toner particles and carrier liquid) of Indigo™, N.V., on an Omnius™ CardPress™ printer of the same company.

The following table summarizes the results:

| | Total weight | Wt. acrylic | Wt. Silica | NVS | Results |
|---|---|---|---|---|---|
| A | 180.3 | 52.5 | 5.3 (9%) | 32% | Only traces of transfer |
| B | 176.7 | 42 | 8.7 (17%) | 29% | Only traces of transfer |
| C | 158.2 | 36.8 | 11.2 (23%) | 32% | Only traces of transfer |
| D | 145 | 29 | 14.5 (33%) | 31% | Good Transfer, Poor Fixing |
| E | 170 | 22 | 15 (40%) | 22% | Good Transfer, Good Fixing |

Coatings D and E resulted in a hazy, rather than clear coating. This may be acceptable for some applications. However, the haziness may be removed by overcoating the film with clear varnish, for example a UV cured varnish. This coating process results in the filling in of the unevenness of the surface caused by the silica, which results in the haziness of the coating. From the table it appears that the coating changes from tonerophobic to tonerophilic at about 25–30% silica loading and that when fixing is good for loading of 35–40% or greater.

EXAMPLE 3

Various amounts of nano-silica (Aerosil R972 by Degussa) was dispersed in an aqueous styrene-acrylic emulsion (Zinpol 280, Worlee—about 48% NVS). Aerosil R972 is a nanometric hydrophobic silica material having a particle size of approximately 16 nanometers. Other sizes, such as between 5 and 50 nanometers are also believed to be useful in the practice of the invention. The dispersions were homogenized in a high shear mixer for 1–3 minutes. The dispersions were diluted with water when for high proportions of silica, when their viscosity made them difficult to homogenize. The resulting coated material was used as a substrate, for ElectroInk™ type 3.1 ink (liquid toner comprising pigmented toner particles and carrier liquid) of Indigo™, N.V., on an Omnius™ CardPress™ printer of the same company.

The following table summarizes the results:

| | Total weight | Wt. acrylic | Wt. Silica | NVS | Results |
|---|---|---|---|---|---|
| A | 186.5 | 43.2 | 6.5 (13%) | 27% | Suffer from Foaming |
| B | 153.7 | 35 | 8.7 (20%) | 28% | Suffer from Foaming |
| C | 164 | 27.1 | 9 (25%) | 22% | Only traces of transfer |
| D | 140.3 | 22.6 | 11.3 (33%) | 24% | Good Transfer, Fair Fixing |
| E | 158.4 | 18.9 | 13.4 (42%) | 20% | Good Transfer, Good Fixing |

A and B suffered from foaming causing an uneven coating. C produced a transparent film, but transfer to it was poor. Coatings D and E resulted in a hazy, rather than clear coating. This may be acceptable for some applications. However, the haziness may be removed by overcoating the film with clear varnish. This coating process results in the filling in of the unevenness of the surface caused by the silica, which results in the haziness of the coating. From the table it appears that the coating changes from tonerophobic to tonerophilic at about 30% silica loading and that fixing is good starting at about 40% loading.

EXAMPLE 4

Various amounts of nano-silica (Aerosil R972 by Degussa) was dispersed in an aqueous PVA solution formed by dissolving polyvinyl alcohol (Aldrich 88% hydrolized—average molecular weight 85 k–146 k) in deionized water to give a 10% solution. Aerosil R972 is a nanometric hydrophobic silica material having a particle size of approximately 16 nanometers.

Other sizes, such as between 5 and 50 nanometers are also believed to be useful in the practice of the invention. The dispersions were homogenized in a high shear mixer for 1–3 minutes. Water was added to reduce the viscosity when it was too high for coating.

The resulting coated material was used as a substrate, for ElectroInk™ type 3.1 ink (liquid toner comprising pigmented toner particles and carrier liquid) of Indigo™, N.V., on an Omnius™ CardPress™ printer of the same company.

The following table summarizes the results:

| | Total weight | Wt. PVA | Wt. Silica | NVS | Results |
|---|---|---|---|---|---|
| A | 204.5 | 15 | 4.5 (23%) | 10% | Poor transfer, Very Poor Fixing |
| B | 139 | 10 | 5 (33%) | 11% | Fair Transfer, Poor Fixing |
| C | 140 | 10 | 6 (37.5%) | 11% | Fair Transfer, Poor Fixing |
| D | 307 | 10 | 7 (41%) | 6% | Good Transfer, Poor Fixing |
| E | 209 | 10 | 9 (47.3%) | 9% | Good Transfer, Good Fixing |

From the table it appears that the coating changes from tonerophobic to tonerophilic at about 30% silica loading and that fixing is good only for loadings above about 45%.

EXAMPLE 5

Highlink OG materials (Clariant) are liquid suspensions of grafted colloidal silica in 1,6-hexanediol diacrylate. Among other organasols which are available are OG 100 in which the organic modifier is 2-Hydroxyethyl methacrylate, OG 101 in which the organic modifier is 2-Hydroxyethyl acetate, OG 103 in which the organic modifier is 1,6-Hexanediol diacrylate and OG 108 in which the modifier is Tripropylene glycol diacrylate. Each of these materials is available in various proportions of modifier and silica, ranging from 30 to 50 percent silica by weight. Since the silica is grafted, the viscosity is lower than for mixtures of ungrafted silica.

To 89 grams of Highlink OG 103-53 (51±1% by weight silica) was added 10 grams of Irgacure 651 organic photo-initiator (Ciba) and the materials were mixed until the initiator was totally dissolved in the carrier of the Highlink material. To this mixture 10 grams of Poly(propylene oxide), diamine terminated (molecular weight 230-Scientific Polymer Products) was added to form a coating material.

This coating material was used to polycarbonate disks (CDI, Ltd.) and Melinex 529 PET films (ICI) by screen printing using a 180 mesh/cm fabric screen. The coating was cured immediately by applying to it light from a 118 watts/cm UV/lamp source and passing the coating by the light source at a velocity of about 5.08 cm/sec or about 23.2 joules/cm$^2$ (A lamp having a power of 300 w/inch and motion of the substrate at a rate of 10 ft/min.) The coating weight was about 5.3 gm/m$^2$.

These coated materials were printed on the Omius™ CardPress™ printer using ElectroInk type 3.1 ink. Transfer and fixing were excellent. Variations of the amounts of additives (diamine 5–20% by weight of the Highlink material and initiator 2–15% by weight of the Highlink material gave good results.

When the Highlink OG 108-53 was replaced by Highlink OG 108-31 (30% silica by weight), the toner did not transfer well to the coated material.

Various amine anchorage agents were used in various experiments to determine their suitability. To 45 gr. Highlink OG 103-53 were added 2.5 grams of Irgacure 184 (CIBA) photoinitiator. The mixture was mixed until the powder was totally incorporated. Then in various experiments 2.5 grams of diamine terminated Poly(propylene oxide) (molecular weight 230, amine content 8.45 meq.), monoamine terminated Poly(propylene oxide) (molecular weight 600, amine content 1.66 meq.) or triamine terminated Polypropylene oxide) (molecular weight 480, amine content 6.45 meq.). The various materials were wire rod coated onto Melinix PET films. The coating was cured immediately by exposure to about 46 joules/cm$^2$ of UV light. The coating weight was estimated at about 15 gm/m$^2$.

These coated PET sheets were printed on in an Omnius™ CardPress™.printer. All the samples showed good transfer of toner to the sheets. The diamine showed good fixing, the triamine showed good to fair fixing and the monoamine showed only fair fixing.

These results demonstrate the dependence of adhesion fixing characteristics on the amine content of the coating.

The present invention has been described with reference to the best mode for carrying out the invention known to the inventors at the time of filing and using toner and printing systems which are readily available to them. It should be understood that the present invention is believed to be applicable to a wide variety of toners, binders and substrate.

As used herein, the terms "include" "have" and "comprise" and their conjugates mean "including but not necessarily limited to".

The invention claimed is:

1. A printing method comprising:

providing a substrate having a surface coated with a film coating comprising between 29% and 47.3% nano-silica by weight in a polymeric binder; and printing on the coated surface with a liquid toner comprising pigmented polymer particles and a carrier liquid.

2. A printing method according to claim 1 wherein the polymeric binder comprises an acrylic material.

3. A printing method according to claim 2 wherein the acrylic material comprises a cross-linked polyacrylic ester.

4. A printing method according to claim 1 wherein the coating is UV cured.

5. A printing method according to claim 1 wherein the coating comprises at least 35% silica.

6. A printing method according to claim 5 wherein the coating comprises at least 40% silica.

7. A printing method according to claim 6 wherein the coating comprises at least 45% silica.

8. A printing method according to claim 1 wherein the silica has a size of between 5 and 50 nanometers.

9. A printing method according to claim 8 wherein the silica has a size of between 10 and 20 nanometers.

10. A printing method according to claim 1 wherein the coating further comprises an anchorage agent.

11. A printing method according to claim 10 wherein the anchorage agent comprises an amine material.

12. A printing method according to claim 11 wherein the substance is poly(propylene oxide).

13. A printing method according to claim 11 wherein the substance is poly-oxyethelene.

14. A printing method according to claim 1 wherein the substrate and the pigmented particles are both acidic.

15. A printing method according to claim 1 wherein the substrate is coated with a polyamide coating between the coating containing silica and the substrate.

16. A printing method according to claim 1 wherein the material of the substrate is chosen from the group consisting of PET, PVC and polycarbonate.

17. A printing method according to claim 1 wherein the coating forms a substantially smooth surface.

18. A printing method according to claim 1 wherein the substrate is a sheet of material.

19. A printing method according to claim 18 wherein the sheet is flexible.

20. A printing method according to claim 19 wherein the resultant print on the sheet is a transparency.

21. A printing method according to claim 18 wherein the sheet is flexible.

22. A printing method according to claim 21 wherein the substrate is a transparency.

23. A printing method according to claim 1 wherein the substrate is a disk.

24. A printing method according to claim 1 wherein the surface of the coating is continuous.

25. A substrate comprising:

a sheet of polymer; and a printable coating in the form of a film, on the polymer sheet comprising between 29% and 47.3% nano-silica by weight of total solids in a polymeric binder.

26. A coated substrate according to claim 25 wherein the polymeric binder comprises an acrylic material.

27. A coated substrate according to claim 26 wherein the acrylic material comprises a cross-linked polyacrylic ester.

28. A coated substrate according to claim 24 wherein the coating is UV cured.

29. A coated substrate according to claim 25 wherein the coating comprises at least 35% silica.

30. A coated substrate according to claim 29 wherein the coating comprises at least 40% silica.

31. A coated substrate according to claim 25 wherein the silica has a size of between 5 and 50 nanometers.

32. A coated substrate according to claim 31 wherein the silica has a size of between 10 and 40 nanometers.

33. A coated substrate according to claim 25 wherein the coating further comprises an anchorage agent.

34. A coated substrate according to claim 33 wherein the anchorage agent comprises an amine material.

35. A coated substrate according to claim 34 wherein the amine material comprises a diamine terminated substance.

36. A coated substrate according to claim 35 wherein the substance is poly(propylene oxide).

37. A coated substrate according to claim 35 wherein the substance is poly-oxyethelene.

38. A coated substrate according to claim 34 wherein the amine material comprises a monoamine terminated substance.

39. A coated substrate according to claim 34 wherein the amine material comprises a triamine terminated substance.

40. A coated substrate according to claim 25 wherein the substrate is acidic.

41. A coated substrate according to claim 25 wherein the substrate is coated with a polyamide coating between the coating containing silica and the sheet.

42. A coated substrate according to claim 25 wherein the material of the sheet is chosen from the group consisting of PVC, PET and polycarbonate.

43. A coated substrate according to claim 25 wherein the coating is smooth.

44. A printing method comprising:

providing a substrate having a surface coated with a film coating comprising between 25% and 47.3% nano-silica by weight in a film formed of a polymeric binder; and printing on the coated surface with a liquid toner comprising pigmented polymer particles and a carrier liquid.

45. A printing method according to claim 44 wherein the polymeric binder comprises an acrylic material.

46. A printing method according to claim 45 wherein the acrylic material comprises a cross-linked polyacrylic ester.

47. A printing method according to claim 44 wherein the coating is UV cured.

48. A printing method according to claim 44 wherein the coating comprises at least 35% silica.

49. A printing method according to claim 48 wherein the coating comprises at least 40% silica.

50. A printing method according to claim 49 wherein the coating comprises at least 45% silica.

51. A printing method according to claim 44 wherein the silica has a size of between 5 and 50 nanometers.

52. A printing method according to claim 51 wherein the silica has a size of between 10 and 20 nanometers.

53. A printing method according to claim 44 wherein the coating further comprises an anchorage agent.

54. A printing method according to claim 53 wherein the anchorage agent comprises an amine material.

55. A printing method according to claim 54 wherein the substance is poly(propylene oxide).

56. A printing method according to claim 54 wherein the substance is poly-oxyethelene.

57. A printing method according to claim 44 wherein the substrate is coated with a polyamide coating between the coating containing silica and the substrate.

58. A printing method according to claim 44 wherein the material of the substrate is chosen from the group consisting of PET, PVC and polycarbonate.

59. A printing method according to claim 44 wherein the substrate is a sheet of material.

60. A printing method according to claim 44 wherein the coating is smooth.

61. A substrate comprising:

a sheet of polymer; and a printable coating in the form of a film, on the polymer sheet comprising between 25% and 47.3% nano-silica by weight of total solids in a film of a polymeric binder.

62. A coated substrate according to claim 61 wherein the polymeric binder comprises an acrylic material.

63. A coated substrate according to claim 62 wherein the acrylic material comprises a cross-linked polyacrylic ester.

64. A coated substrate according to claim 61 wherein the coating contains at least 30% silica.

65. A coated substrate according to claim 64 wherein the coating comprises at least 35% silica.

66. A coated substrate according to claim 65 wherein the coating comprises at least 40% silica.

67. A coated substrate according to claim 66 wherein the coating comprises at least 45% silica.

68. A coated substrate according to claim 61 wherein the silica has a size of between 5 and 50 nanometers.

69. A coated substrate according to claim 68 wherein the silica has a size of between 10 and 20 nanometers.

70. A coated substrate according to claim 61 wherein the material of the sheet is chosen from the group consisting of PVC, PET and polycarbonate.

* * * * *